United States Patent [19]

Ritten

[11] Patent Number: 4,712,503

[45] Date of Patent: Dec. 15, 1987

[54] BOAT TRANSOM PLATFORM STEP DEVICE

[75] Inventor: Robert G. Ritten, Ft. Pierce, Fla.

[73] Assignee: Step On Inc., Ft. Pierce, Fla.

[21] Appl. No.: 40,889

[22] Filed: Apr. 20, 1987

[51] Int. Cl.[4] ..... E06C 5/26

[52] U.S. Cl. ..... 114/343; 114/362; 182/86

[58] Field of Search ..... 114/343, 362, 364, 363; 182/53, 55, 62, 150, 90, 91, 92, 97, 86; 280/166

[56] References Cited

U.S. PATENT DOCUMENTS

| | | | |
|---|---|---|---|
| 3,195,680 | 7/1965 | Thornburg et al. | 114/362 |
| 3,774,720 | 11/1973 | Hovey | 182/97 |
| 3,794,140 | 2/1974 | Sell | 114/362 |
| 3,804,200 | 4/1974 | Sandberg | 114/362 |
| 4,191,388 | 3/1980 | Barksdale | 182/92 |
| 4,462,485 | 7/1984 | Terry et al. | 114/363 |
| 4,541,507 | 9/1985 | Gibellato | 182/97 |

FOREIGN PATENT DOCUMENTS

| | | | |
|---|---|---|---|
| 2214874 | 4/1973 | Fed. Rep. of Germany | 114/362 |

*Primary Examiner*—Jeffrey V. Nase
*Assistant Examiner*—Stephen P. Avila
*Attorney, Agent, or Firm*—Carroll F. Palmer

[57] ABSTRACT

A step device for mounting on the transom platform of a boat that may be moved between a use position wherein a step thereof is immersed in the water in which the boat floats and a storage position wherein the step is located above the platform out of the water formed of a step unit, a pair of bracket units and a pair of pin members. The step unit when in the use position permits a person to climb out of the water and onto the platform without the step making any appreciable movement relative to the platform during such climb because of its unique construction which includes a pair of support members each having an L-shaped portion that includes a leg section and a step section joined normally to the leg section via an arcuate section, a lateral portion that extends integrally and normally from the top end of the L-shaped portion, and an abutment portion that extends integrally from such lateral portion in the direction of the step section spaced apart from and parallel to the leg section. When the device is mounted on a boat platform, the abutment portions of support members function to hold the step unit in a steady use position.

5 Claims, 5 Drawing Figures

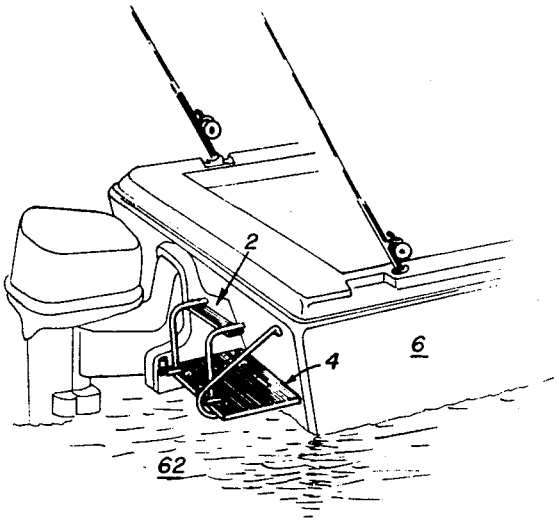
FIG. 1
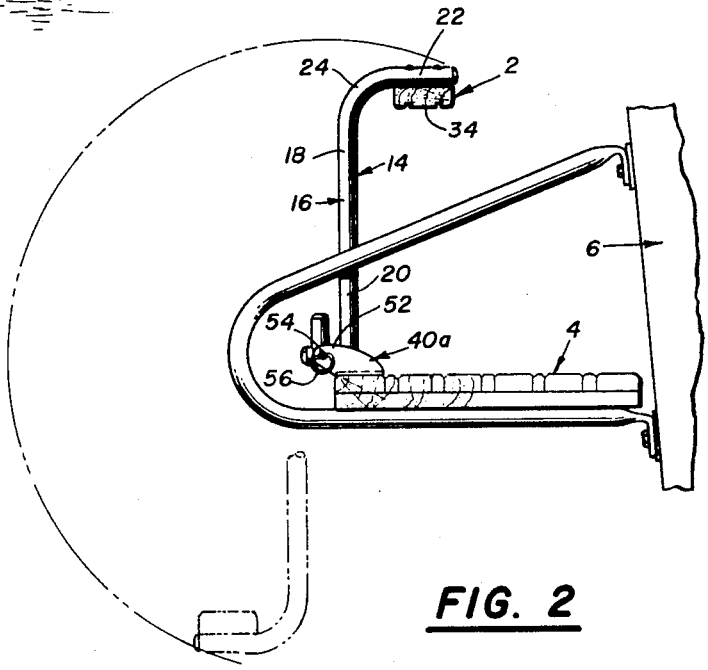
FIG. 2
FIG. 3
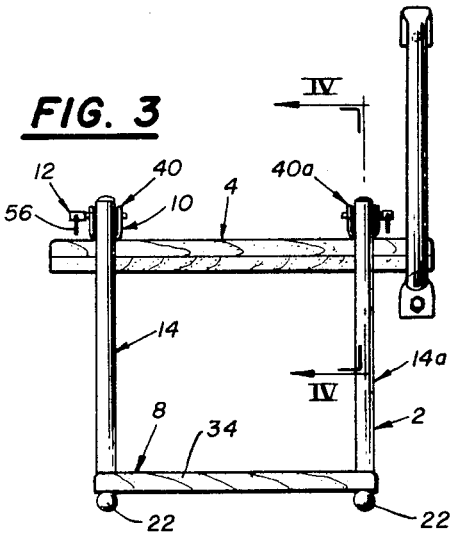
FIG. 5
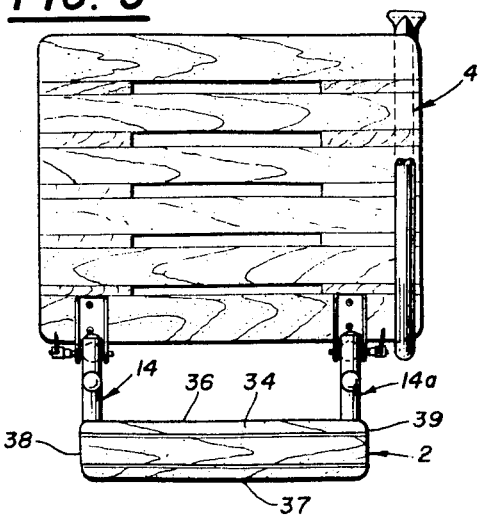
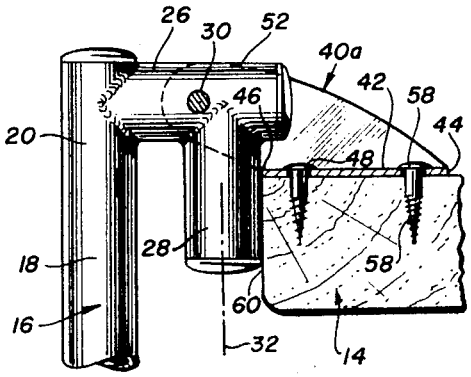
FIG. 4

BOAT TRANSOM PLATFORM STEP DEVICE

BACKGROUND OF THE INVENTION

1. Field of the Invention

This invention relates broadly to step devices for boats. More particularly, it concerns step devices for mounting on the transom platform of a boat that may be moved between a use position wherein a step thereof is immersed in the water in which the boat floats and a storage position wherein the step is located above the platform out of the water, which step when in the use position permits a person to climb out of the water and onto the platform without the step making any appreciable movement relative to the platform during such climb.

2. Description of the Prior Art

A variety of platform and step devices have been developed and marketed for attachment to the transoms of boats to assist in boarding or debarking the boats or to help in moving or working about the stern of the boats. These prior devices can be divided broadly into three classes, i.e., (1) those that are strictly ladders and provide no real platform function (see U.S. Pat. No. 3,774,720), (2) those that are strictly platforms and (3) those that provide combination step and platform functions (see U.S. Pat. Nos. 3,195,680 and 4,462,485). The present invention relates the devices of the third type.

In the devices of the third type in the prior art there is typically a platform that attaches to the boat transom plus some form of depending step arrangement that assist the user of the device to lower or raise his body upon one or more steps positioned at a level below the platform. In some forms of such devices, the depending step or steps are fixed immoveably to the platform while in others the step or steps are hinged or otherwise arranged to move between a lowered, use position and a raised, storage position. The present invention concerns boat ladder devices of the moveable step type.

The prior art devices of the type to which the present invention relates as stated above have some undesirable aspects. For example, many such type prior art devices have a moveable step section mounted to the platform section in a manner that the step section is not sturdily fixed when in the lowered, use position with the result that the user is bothered by having to lift his body on an unsteady step. This is particularly bothersome when the user is carrying heavy gear, e.g., scuba gear, since the added weight serves to aggravate the unstable conditions. The present invention provides a solution to this type of boat step problem.

OBJECTS

A principal object of the invention is the provision of improved forms of step devices for attachment to transom platforms on boats.

Further objects include the provision of:

1. Such devices having moveable step sections in which the step section when in the lowered, use position is fixed against swinging or other movement relative to the platform to which attached so a user is presented with steady step or steps upon which to lift his body and any gear that he carries.

2. New boat ladder-platform combinations having improved safety and function features.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

The objects are accomplished, in part, in accordance with the invention by the provision of step devices for mounting on the transom platform of a boat to present a step that may be moved between a use position wherein the step is immersed in the water in which the boat floats and a storage position wherein the step is located above the platform out of the water, which step in the use position permits a person to climb out of the water and onto the platform without the step making any appreciable movement relative to the platform during such climb.

Such new step devices comprise a step means, a bracket means and a pair of pin members.

The step means comprises a first tubular support member including (a) an L-shaped portion defined by a leg section with a top end and a step section joined normally to the leg section via an arcuate section, (b) a lateral portion that extends integrally and normally from the top end of the L-shaped portion and (c) an abutment portion that extends integrally from the lateral portion in the direction of the step section spaced apart from and parallel to the leg section. The L-shaped, the lateral and the abutment portions all lie in the same longitudinal plane and there is a bore through the lateral portion normal to such plane between the L-shaped portion and the center-line of the abutment portion.

The device further comprises a second tubular support member substantially identical to and spaced apart from the first tubular support member. A flat, rectangular step defined by two longitudinal sides and two ends is fixed adjacent one of its ends to the step section of the first support member and adjacent the other of its ends to the step section of the second support member.

The bracket means comprises (1) a first mount member having a rectangular base section with a fore end, an aft end and fastener admission holes and (2) a pair of integral side sections that project laterally from the base section. Such side sections are spaced apart from each other a distance slightly greater than the width of the tubing of which the aforesaid first and second support members are formed. These side sections extend beyond the aft end of the base section and there is a hole in each of the side sections in the area thereof that is beyond such aft end.

The device further comprises a second mount member substantially identical to the first mount member. One of the pln members of the new step device extends through the holes in the first mount member and the aforesaid bore in the first support member connecting them together and the second of the pin members similarly extends through the holes in the second mount member and the bore in the second support member connecting them together.

In preferred embodiments of the new step devices, the support members are made of stainless steel tubing, the step is made of wood and the pin members are quick release lock pins.

The objects are further accomplished by the provision of a platform mounted on the transom of a boat that has a step device as described above mounted thereon by fasteners that extend through the fastener admission holes of the mount members.

BRIEF DESCRIPTION OF THE DRAWINGS

A more complete understanding of the invention may be had by reference to the accompanying drawings in which:

FIG. 1 is a fragmentary, perspective view of the transom of a boat equipped with a new platform step device of the invention.

FIG. 2 is a fragmentary lateral view of the platform and step device of FIG. 1.

FIG. 3 is a rear view of the platform and step device of FIG. 1.

FIG. 4 is a fragmentary, enlarged sectional view taken on the line IV—IV of FIG. 3.

FIG. 5 is a plan view of the platform and step device of FIG. 1.

DESCRIPTION OF THE PREFERRED EMBODIMENTS

Referring in detail to the drawings, in which identical parts are identically marked, the invention comprises a step device 2 for mounting on the transom platform 4 of boat 6.

The device 2 comprises a step means 8, a bracket means 10 and a pair of pin members 12.

The step means 8 includes a first tubular support member 14 having an L-shaped portion 16 defined by a leg section 18 with a top end 20 and a step section 22 joined normally to the leg section via an arcuate section 24.

A lateral portion 26 extends integrally and normally from the top end 20 of the L-shaped portion 16 and an abutment portion 28 extends integrally from the lateral portion 26 in the direction of the step section 22 spaced apart from and parallel to the leg section 18. The portions 16, 26 & 28 all lie in the same longitudinal plane and a bore 30 extends through the lateral portion normal to such plane between the L-shaped portion 16 and the center-line 32 of the abutment portion 28.

There is second tubular support member **14*a* substantially identical to and spaced apart from the first tubular support member 14. A flat, rectangular step 34 with two longitudinal sides 36 & 37 and two ends 38 & 39 is fixed adjacent end 38 to the step section 22 of the support member 14 and adjacent end 39 to the step section 22 of the support member 14*a***.

The bracket means 10 comprises a first mount member 40 and a substantially identical second mount member **40*a*, each including a rectangular base section 42 with a fore end 44, an aft end 46 and fastener admission holes 48 and a pair of integral side sections 50 that project laterally from the base section 42**.

The side sections 50 are spaced apart from each other a distance slightly greater than the width of the tubing of which the first and second support members 14 & **14*a* are formed and their aft ends 52 extend beyond the aft end 46 of the base section 42. There is a hole 54 in each of the side sections 50 in the area of the aft end 52**.

One of the pin members 12 extends through the holes 54 in the first mount member 40 and the bore 30 in the support member 14 connecting them together and the second of the pin members 12 extends through the holes 54 in the mount member **40*a* and the bore 30 in the support member 14*a* connecting them together. Preferred pin members for use in the invention are so-called fast release pins that include a spring release mechanism (not shown) to retain them in holes into which they are inserted and rings 56 to assist in pulling then out of such holes. Alternatively, the pin members 12** may be cotter pins, bolts or like fasteners.

The platform 4 has the step device 2 fixed thereto by screws 58 or other fasteners that extend through the fastener admission holes 48 of the mount members 40 & **40*a*. When so positioned, the step device may be moved between a storage position as shown in FIG. 2 and a use position as shown in FIG. 3. In the use position, the abutment portion 28 bears against the aft edge 60 of the platform 4 and retains the L-shaped portion 16 substantially unmoveable when a user of the ladder (not shown) applies weight to the step 34 to climb out of the water 62 onto the platform 4**.

The embodiments of the invention in which an exclusive property or privilege is claimed are defined as follows:

1. A step device for mounting on the transom platform of a boat that may be moved between a use position wherein a step thereof is immersed in the water in which the boat floats and a storage position wherein said step is located above said platform out of said water, which step in said use position permits a person to climb out of said water and onto said platform without said step making any appreciable movement relative to said platform during such climb, comprising:

a step means, a bracket means and a pair of pin members.

said step means including:

a first tubular support member having:

an L-shaped portion defined by a leg section with a top end and a step section joined normally to said leg section via an arcuate section, a lateral portion that extends integrally and normally from said top end of said L-shaped portion, an abutment portion that extends integrally from said lateral portion in the direction of said step section spaced apart from and parallel to said leg section, said L-shaped, said lateral and said abutment portions all lying in a the same longitudinal plane, and a bore through said lateral portion normal to said plane between said L-shaped portion and the center-line of said abutment portion, a second tubular support member substantially identical to and spaced apart from said first tubular support member, a flat, rectangular step defined by two longitudinal sides and two ends, said step being fixed adjacent one of said ends to said step section of said first support member and adjacent the other of said ends to said step section of said second support member, and said bracket means including:

a first mount member having:

a rectangular base section with a fore end, and aft end and fastener admission holes, a pair of integral side sections that project laterally from said base section, said side sections being spaced apart from each other a distance slightly greater than the width of the tubing of which said first and second support members are formed, said side sections extending beyond said aft end of said base section, and a hole in each of said side sections in the area thereof that is beyond said aft end, and a second mount member substantially identical to said first mount member, one of said pin members extending through said holes in said first mount member and said bore in said first support member connecting them together, and the second of said pin members extending through said holes in said second mount member and said bore in said second support member connecting them together.

2. The step device of claim 1 wherein said support members are made of stainless steel tubing.

3. The step device of claim 2 wherein said step is made of wood.

4. The step device of claim 1 wherein said pin members are quick release lock pins.

5. A platform mounted on the transom of a boat that has a step thereon that may be moved between a use position wherein said step is immersed in the water in which said boat floats and a storage position wherein said step is located above said platform out of said water, which step in said use position permits a person to climb out of said water and onto said platform without said step making any appreciable movement relative to said platform during such climb, comprising:

a platform, a step means, a bracket means and a pair of pin members, said step means including:

a first tubular support member having:

an L-shaped portion defined by a leg section with a top end and a step section joined normally to said leg section via an arcuate section, a lateral portion that extends integrally and normally from said top end of said L-shaped portion, an abutment portion that extends integrally from said lateral portion in the direction of said step section spaced apart from and parallel to said leg section, said L-shaped, said lateral and said abutment portions all lying in a the same longitudinal plane, and a bore through said lateral portion normal to said plane between said L-shaped portion and the center-line of said abutment portion, a second tubular support member substantially identical to and spaced apart from said first tubular support member, a flat, rectangular step defined by two longitudinal sides and two ends, said step being fixed adjacent one of said ends to said step section of said first support member and adjacent the other of said ends to said step section of said second support member, and said bracket means including:

a first mount member having:

a rectangular base section with a fore end, an aft end and fastener admission holes, a pair of integral side sections that project laterally from said base section, said side sections being spaced apart from each other a distance slightly greater than the width of the tubing of which said first and second support members are formed, said side sections extending beyond said aft end of said base section, and a hole in each of said side sections in the area thereof that is beyond said aft end, and a second mount member substantially identical to said first mount member, one of said pin members extending through said holes in said first mount member and said bore in said first support member connecting them together, and the second of said pin members extending through said holes in said second mount member and said bore in said second support member connecting them together, said first and second support members being fixed to said platform by fasteners that extend through said fastener admission holes of said mount members.

* * * * *